US005425753A

United States Patent [19]

Wege et al.

[11] Patent Number: 5,425,753

[45] Date of Patent: Jun. 20, 1995

[54] PORTABLE STEAM BATH UNIT FOR USE WITH A TABLE

[75] Inventors: Christopher H. Wege; Richard Eidson; Bolton S. Carroll, all of Fairfield, Iowa

[73] Assignee: Perfect Health Development, Fairfield, Iowa

[21] Appl. No.: 182,559

[22] Filed: Jan. 18, 1994

[51] Int. Cl.[6] ..... A61H 33/06

[52] U.S. Cl. ..... 607/83; 4/536

[58] Field of Search ..... 607/81-87; 600/21-22; 4/535-536

[56] References Cited

U.S. PATENT DOCUMENTS

| | | | |
|---|---|---|---|
| 959,743 | 5/1910 | Hoyt . | |
| 1,358,060 | 11/1920 | Crum . | |
| 1,395,912 | 11/1921 | Ferentzi | 607/81 X |
| 1,573,016 | 2/1926 | Pedroes . | |
| 1,968,015 | 7/1934 | Cooke et al. | 607/81 |
| 2,012,221 | 8/1935 | Clark et al. . | |
| 2,033,040 | 3/1936 | Lini . | |
| 2,098,316 | 11/1937 | Sittler | 607/83 |
| 2,184,418 | 12/1939 | Faigle . | |
| 2,298,246 | 10/1942 | McCann . | |
| 2,333,231 | 11/1943 | Berg . | |
| 2,579,964 | 12/1951 | Reynolds . | |
| 2,640,201 | 6/1953 | Burwell | 607/83 X |
| 2,960,986 | 11/1960 | Gibbons . | |
| 3,878,570 | 4/1975 | Donnelly | 600/22 X |
| 4,712,538 | 11/1987 | Hardie et al. | 607/83 X |

*Primary Examiner*—Angela D. Sykes

*Attorney, Agent, or Firm*—Browdy and Neimark

[57] ABSTRACT

A portable steam unit for use with a conventional table including a massage table includes a cloth canopy, bowed reinforcing battens and collapsible reinforcing poles. The battens are slidably engaged within first sleeves transverse to a longitudinal length on the canopy, and the poles are slidably engaged within second sleeves extending along the longitudinal length of the canopy. The unit also includes a cloth pad having edges shaped to form fit open edges of the table. A closure at the back end of the canopy extends beyond the back edge of the table. A bottom side on the closure which extends back to the table, a cylindrical stack extending downward therefrom to engage the exhaust exit of a hot pot resting on the floor supporting the table. The hot pot provides warm moist air to the interior of the cloth canopy. A fan can be provided :for circulating heated air from the hot pot within the canopy.

16 Claims, 3 Drawing Sheets

PORTABLE STEAM BATH UNIT FOR USE WITH A TABLE

BACKGROUND OF THE INVENTION

1. Field of the Invention

This invention relates to steam bath units and in particular to a portable steam bath unit for use with conventional tables, beds or platforms including, in particular, massage tables. The portability of the steam bath unit according to the invention is facilitated by the distribution of all the unassembled elements necessary to erect the unit in the form of a kit. The portable steam bath unit is intended for use in homes, masseur establishments, beauty salons, therapeutic clinics, etc., with conventional tables, beds or platforms either available to, or owned by, an intended user for the purpose of providing hands on physical treatment by physical therapists, massage therapists, chiropractors, nurse, accupuncturists, and etc.

Prior art steam bath units have not been readily useable with conventional tables as the steam bath unit is generally made to be integrally engaged in one manner or another to a table specifically manufactured to accommodate apparatus permitting the combination to be used as a steam bath unit. Further, to the extent a prior art steam bath unit might be used with a conventional table they have not been readily portable in the form of a kit according to the invention.

Some examples of such prior art devices are described as follows.

Lini, U.S. Pat. No. 2,033,040, discloses a portable bath that features bowed elements supporting a cover, and generation of moist heat from a boiler or dry heat from electrical heating elements. The steam generating and distributing apparatus is built into the table. The portable nature of this apparatus is in the wheels, not in the cover/support and the heating elements.

Berg, U.S. Pat. No. 2,333,231, discloses a therapeutic apparatus that generates warn humidified air under a canopy. This is not a portable arrangement and the moist air generating and distributing means is built into the table.

Faigle, U.S. Pat. No. 2,184,418, discloses a massage table with a cover formed of a hinged hood assembly having individual sections which are shown to be rigid. Heater units, located in the table and in the cover, provided radiant heat. Individual sections of the hinged hood assembly can be lowered to expose a body portion to therapy.

Gibbons, U.S. Pat. No. 2,960,986, discloses a massage table with two separate reflecting hoods or covers with lamp bulbs attached to provide radiant heat. The reflecting hoods are half cylinders made of a rigid material.

Reynolds, U.S. Pat. No. 2,579,964, discloses a radiant cover, made of heat-conducting material, which is adapted to be supported over a bed. FIG. 4 and the disclosure show flexible blanket-like panels or covers that can be heated, preferably by electrical means.

None of the above prior art devices described above achieve the portability and ease of use with conventional tables provided by a kit according to the invention. Further, none of the above prior art devices disclose apparatus which can be separably attached to a conventional table including a standard massage table in order to provide steam bath capabilities.

Accordingly, it is a primary object of the present invention to provide a portable steam bath unit which can be simply assembled from a kit for use with conventional tables (including massage tables) which are readily available to a user.

A further object of the invention is to provide a portable steam bath unit that can be easily disassembled and packaged for storage or transfer from one place to another.

Another object of the invention is to provide a portable steam bath unit wherein the surfaces can be readily cleaned and maintained in a sterile condition.

Yet another object of the invention is to provide a portable steam bath unit for use with a conventional table having a closure within which the main portion of a user's body can be subjected to various treatments including the actions of warm air.

It is, accordingly, an object of the present invention to overcome the limited portability of previous steam bath units by providing a steam bath unit that can be transferred in the form of a kit and is simple in construction, economical to manufacture, efficient in use and easily disassembled and packaged for storage or transfer.

SUMMARY OF THE INVENTION

The above objectives are achieved by a portable steam unit according to the invention having a cleanable or washable cloth canopy having closures at both ends of the canopy. The canopy is maintained in open position above the table chosen for use by a plurality of bowed reinforcing battens engaged in sleeves formed on the canopy, the sleeves being substantially perpendicular to the longitudinal length of the canopy. The canopy is further maintained open in its longitudinal direction by a plurality of collapsible reinforcing poles engaged in a plurality of sleeves extending along the length of the canopy.

The unit further includes a cloth pad having edges shaped to form fit open edges of the table on which the unit is to be used. The edges of the pad have a mating portion of a fastener corresponding to a mating portion on the longitudinal edges of the canopy to assist engagement of the canopy to the table and/or pad.

The closure at the back end of the canopy is made to extend beyond the back edge of the table on which it is assembled. This includes a bottom side on the closure which extends back to the table and from which a cylindrical stack extends down to engage the exhaust exit of a hot pot resting on the same floor supporting the table on which the steam bath unit is assembled. The engaged hot pot then provides warm moist air to the interior of the cloth canopy covering the table.

An opening is formed on the front closure to allow a user head to extend outside the canopy. Further, a battery powered fan is provided for engagement within the canopy near the stack inlet to assist circulating heated air from the hot pot within the canopy.

Other objects of the invention will appear in the following detailed description taken in connection with the accompanying drawings.

DETAILED DESCRIPTION OF THE PREFERRED EMBODIMENT OF THE INVENTION

Figure 1:
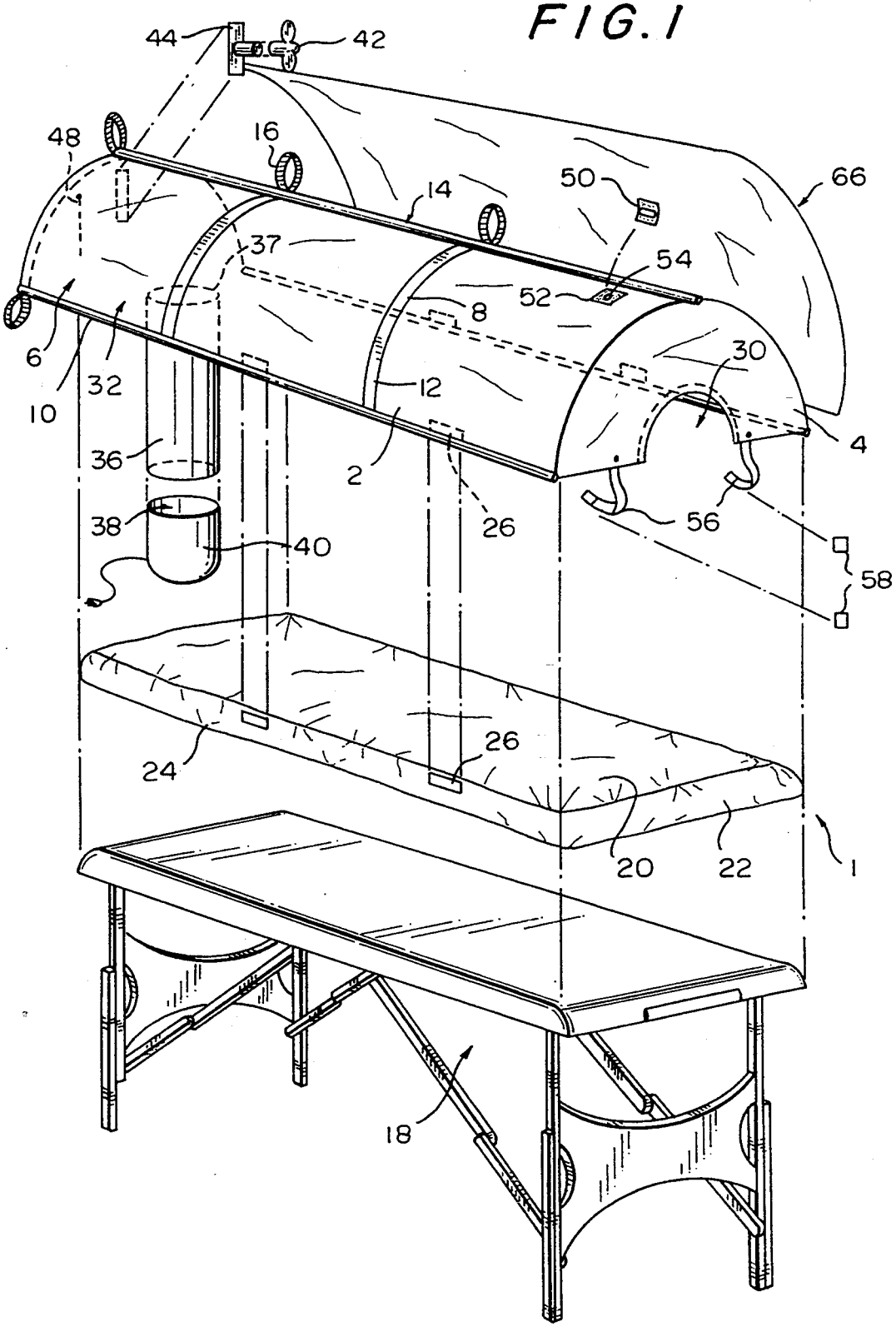
FIG. 1 is an exploded view of the portable steam bath unit according to the invention shown in association with a table on which it is to be assembled.
Figure 3A:
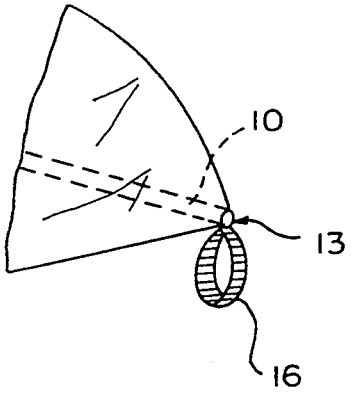
FIG. 3 shows a rear view of the portable steam bath unit according to the invention assembled on a table.
Figure 3:
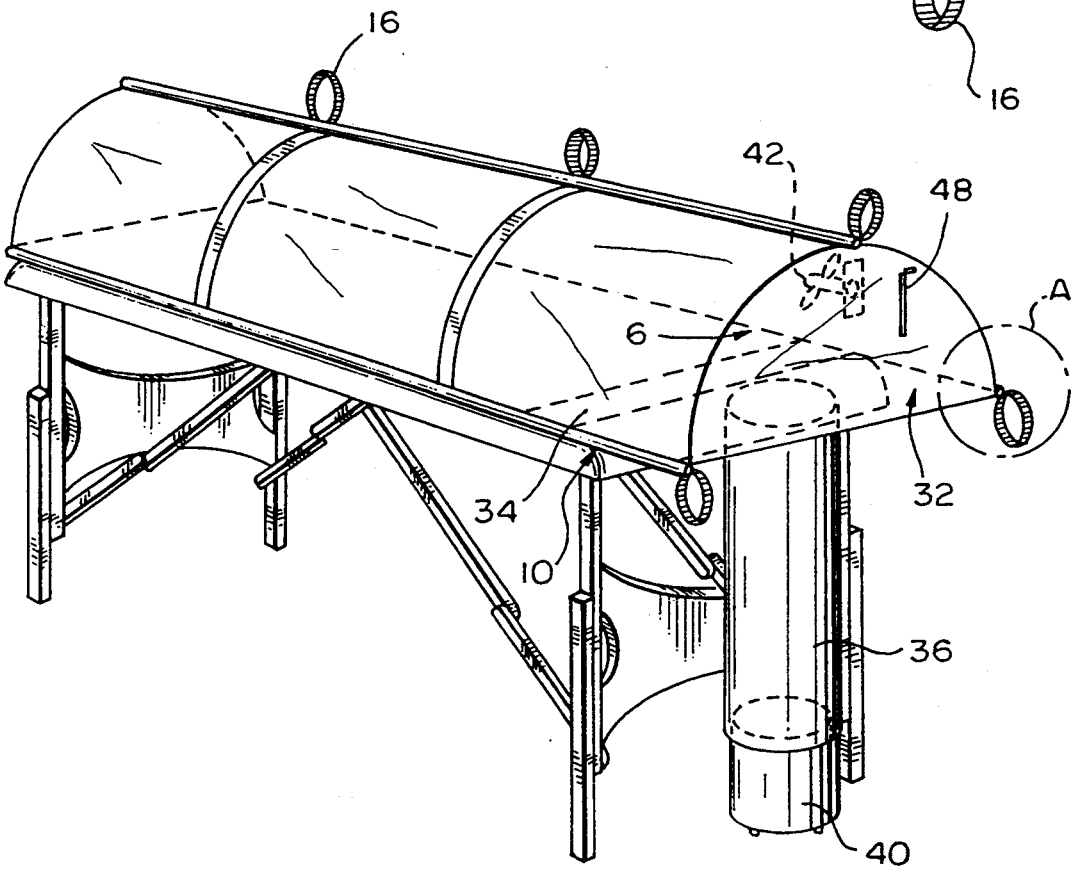
Figure 4:
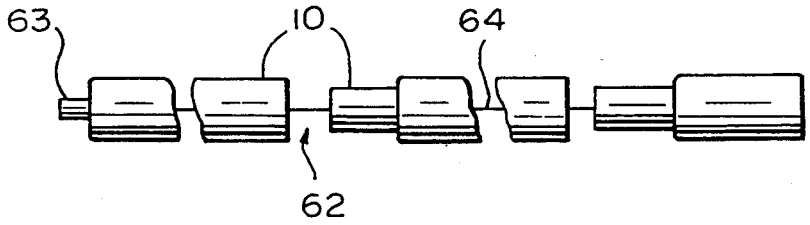
FIG. 4 shows a joint between segments of a reinforcing pole according to the invention.

FIG. 1 shows all the elements making up the kit forming the portable steam bath unit 1 according to the invention in partially unassembled form. Theses elements include a cleanable or washable cloth canopy 2 having a front closure 4 and a rear closure 6 arranged in an open position by a plurality of flexible bowed battens 8 and collapsible reinforcing poles 10. Both battens 8 and poles 10 can be fashioned from either wood, composite, plastic or metal. Battens 8 and poles 10 are respectively held in engagement on canopy 2 by transverse sleeves 12 and longitudinal sleeves 14 provided on the surface of the canopy 2. The end of each sleeve 12 or 14 may be closed at one end to better maintain battens 8 or poles 10 within their respective sleeve. Further, a pole 10 can be maintained fixed within its respective sleeve by a grommet 13 snapped over nipple 63 at its end as shown in circle A of FIG. 3 and FIG. 4. Pole 10 can also be fixed with its respective sleeve by a velcro flap over the open end of the sleeve (not shown). Web loops 16 are fixed at various points on canopy 2 to assist assembly and disassembly of battens 8 and poles 10 in sleeves 12 and 14, as well as removing an open canopy 2 from a the table 18 on which it is assembled. It is understood that reference to table 18 hereafter includes the possible use of a beds or platforms or massage table.

The steam bath unit further includes a cloth pad 20 having respective transverse and longitudinal edges 22 and 24 shaped to form fit over table 18 on which the pad is to be assembled. Each opposing longitudinal edge 24 has a mating portion of velcro fastener 26 which engages a corresponding mating portion on each opposing longitudinal edge of canopy 2 to assist engagement of canopy 2 to table 18 and pad 20. It is understood that fastener 26 may also be a snap fastener or the like, if found more desirable.

An opening 30 is formed on front closure 4 to allow, if desired, the head of a user to extend outside the canopy 2 and rest on a head support engaged on the end of table 18 (not shown). Rear closure 6 is made to extend beyond the back edge of table 18 on which it is assembled. A bottom side 32 which overlaps the end of table 18' on an area 34 is provided as part of rear closure 6 to maintain the canopy 2 closed at the end of table 18. A cylindrical stack 36 extends down from inlet hole 37 on the bottom side 32 to engage an exhaust exit 38 of a hot pot 40 standing on the same floor supporting table 18. The hot pot 40 can be filled with water and herbs, or aroma oils, etco to generate moist air for a medicinal bath, if so desired. Cylindrical stack 36 is also made from washable cloth with an interior lining of conventional space blanket material or other known flexible insulating material which protects the cloth from the heated air rising from hot pot 40 into the interior of canopy 2 through inlet hole 37 and maintains the maximum heat in the rising air.

A battery powered fan 42 is mounted on a mating portion of velcro fastener 44 which is releasably mounted to the corresponding mating portion fixed to the interior of canopy 2. Fan 42 can be inserted and engaged to fastener 44 through zipper opening 48, which opening also serves to provide ventilation to cool down the interior of the canopy 2 if considered desirable. When fan 42 is in operation it serves to circulate warm air from hot pot 40 within canopy 2.

A thermometer 50 is releasably fixed to the exterior of canopy 2 by velcro fastener 52. Thermometer 50 communicates and monitors the temperature within the interior of canopy 2 through hole 54.

Figure 2:
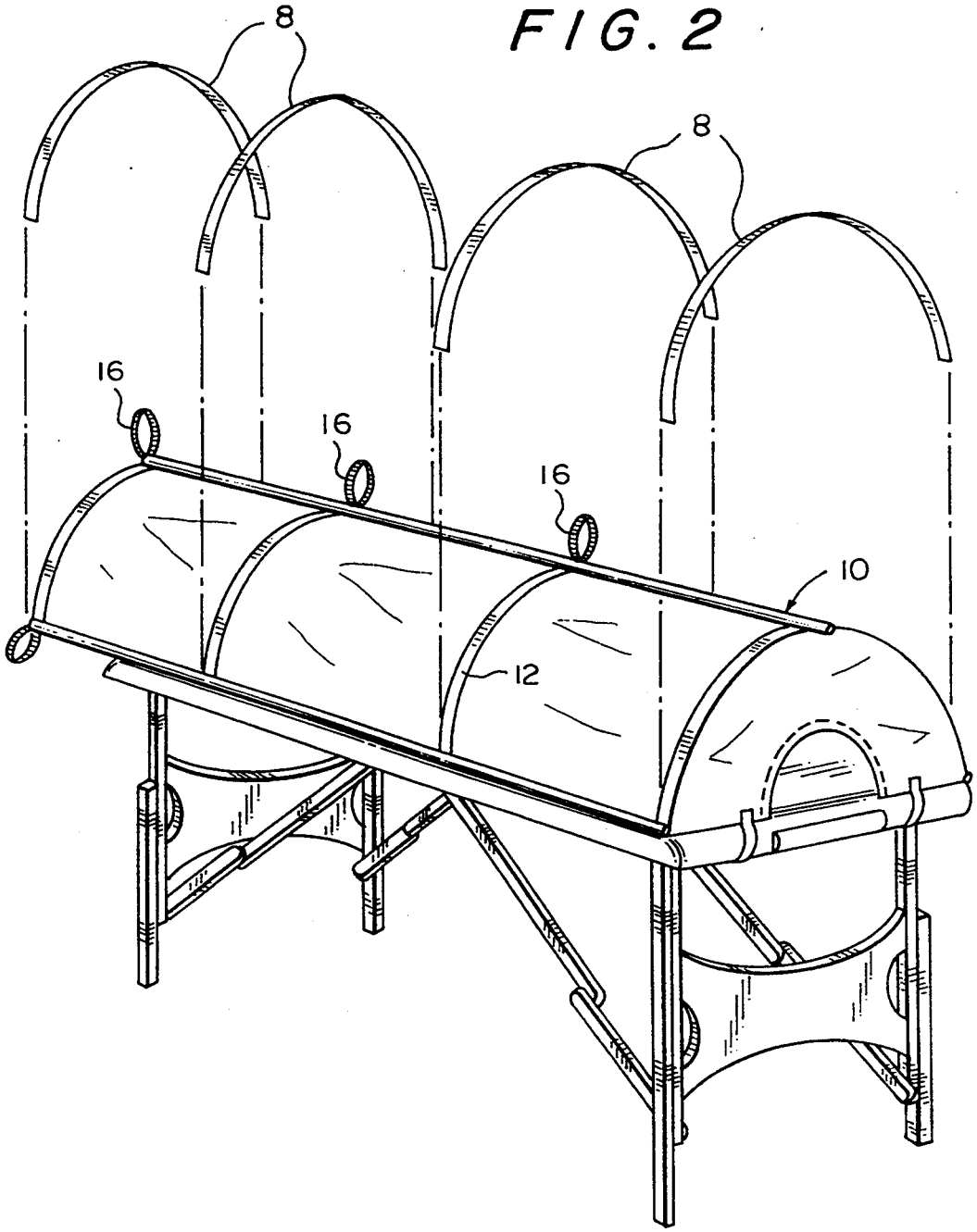
FIG. 2 shows a front view of the portable steam bath unit according to the invention assembled on a table.

As shown in FIGS. 1 and 2 straps 56 are provided to further secure closure 4 to pad 20 on table 18 by velcro fasteners 58 secured at the ends of straps 56 for engagement to a corresponding mating portion secured to either the bottom edge of pad edge 22 or the front edge of table 18. FIG. 1 shows a disassembled mating portion of fastener 58 for use in engaging to the pad or table.

To permit storing and transfer of the steam bath unit in the smallest possible kits poles 10 are made to collapse into a selected number of small segments. This can be accomplished in a number of different ways including the provision of a telescoping joint 62 shown in FIG. 4 between abutting segments of a pole 10. An elastic shock cord 64 fastened to the ends of the outermost segments of pole 10 can be used to maintain engagement of joints 62 when a pole 10 is erected to be operational or when disassembled to preclude loss of component segments.

A blanket 66 lined with space blanket material or other insulating material is also provided with the steam bath unit in a size adapted to cover canopy 2. Blanket 66 can be selectively used by the user to increase the temperature within the canopy if deemed desirable.

While the invention has been described by reference to a preferred embodiment chosen for purposes of illustration, it should be understood that numerous changes could be made in the described features without departing from the spirit and scope of the inventive concepts disclosed. Accordingly, it is intended that the invention not be limited to the feature of the disclosed embodiment but that it have the full scope permitted by the language of the following claims.

We claim:

1. A portable steam unit for use with a conventional table including a massage table, said unit comprising:

a cloth canopy having a front closure and a rear closure, a plurality of bowed reinforcing battens, a plurality of collapsible reinforcing poles, each of said plurality of bowed reinforcing battens slidably engaged within one of a plurality of first sleeves on said canopy transverse to a longitudinal length of said cloth canopy, each of said plurality of collapsible reinforcing poles slidably engaged within one of a plurality of second sleeves extending along said longitudinal length of said cloth canopy, a cloth pad having edges shaded to form fit over edges of said conventional table when assembled thereon, said front closure having an opening for a person under treatment and engagement means for engaging a front end of said conventional table when said canopy is assembled on said conventional table, said rear closure projecting beyond a rear end of said conventional table when said front closure is aligned with said front end of said conventional table, said rear closure having a bottom side overlapping said cloth pad when said cloth canopy and said cloth pad are assembled on said conventional table, a cylindrical stack extending down from said bottom side and having an interior communicating with an interior of said cloth canopy, wherein when said cloth canopy is assembled over said conventional table a free end of said cylindrical stack is engaged to a hot pot outside a periphery of said conventional table to deliver warm air to said interior of said cloth canopy, wherein each of said plurality of collapsible reinforcing poles is divided into segments having corresponding end joints and maintained together by a shock cord.

2. The unit according to claim 1, wherein a battery powered fan is releasably engaged within said cloth canopy proximate to said rear closure.

3. The unit according to claim 1, wherein a thermometer extending into said interior of said cloth canopy is releasably engaged to an exterior of said canopy.

4. The unit according to claim 1, wherein, each of two sleeves of said plurality of first sleeves respectively extend along a front end and a back end of said cloth canopy.

5. The unit according to claim 1, wherein one of said plurality of second sleeves extends along an apex of said canopy and each of two other sleeves of said plurality of second sleeves respectively extend along a longitudinal edge of said cloth canopy.

6. The unit according to claim 1, wherein said cloth canopy and said cloth pad have corresponding fastening means thereon to releasably engage said cloth canopy to said cloth pad when said cloth canopy and cloth pad are assembled on said conventional table.

7. The unit according to claim 1, wherein web loops are engaged to said cloth canopy to facilitate assembly and disassembly of said unit.

8. A kit including elements which can be assembled into a steam bath unit, said kit comprising;

a cloth canopy having a front closure and a rear closure, said rear closure having a bottom side from which a cylindrical stack extends, a plurality of bowed reinforcing battens, a plurality of collapsible reinforcing poles, wherein each of said plurality of collapsible reinforcing holes is divided into securements having corresponding end joints and maintained together by a shock cord, said cloth canopy having a plurality of first sleeves extending transverse to a longitudinal length of said canopy, and a plurality of second sleeves extending along said longitudinal length, a cloth pad having edges shaped to form fit over edges of a conventional table, a hot pot for producing warm air, a battery powered fan releasably fastened to the interior of said canopy and a thermometer which can be releasably fastened to the exterior of said canopy.

9. A portable steam bath unit for use with a massage table, comprising:

removable canopy means for enclosing a person receiving the steam bath when in use, said canopy means being connectable to an removable from a massage table;

a portable steam generating means for generating steam located outside a periphery of said table;

conduit means for directing steam generated by said generating means to the interior of said canopy means when in use; and further including fan means positioned within the interior of said canopy means for circulating steam from said steam generating means over the person receiving the steam bath, wherein said removable canopy means comprises:

a cloth canopy having a front closure and a rear closure, and a plurality of collapsible reinforcing poles, wherein each of said plurality of collapsible reinforcing poles is divided into segments having corresponding end joints and maintained together by a shock cord.

10. A portable steam unit according to claim 9, wherein said removable canopy means further comprises:

a plurality of bowed reinforcing battens, wherein each of said plurality of bowed reinforcing battens is slidably engaged within one of a plurality of first sleeves on said canopy transverse to a longitudinal length of said cloth canopy, each of said plurality of collapsible reinforcing poles is slidably engaged within one of a plurality of second sleeves extending along said longitudinal length of said cloth canopy, a cloth pad having edges shaped to form fit over edges of said table when assembled thereon, said front closure having an opening for a person under treatment and engagement means for engaging a front end of said table when said canopy is assembled on said table, said rear closure projecting beyond a rear end of said table when said front closure is aligned with said front end of said table, said rear closure having a bottom side overlapping said cloth pad when said cloth canopy and said cloth pad are assembled on said table, said conduit means extending down from said bottom side and having an interior communicating with an interior of said cloth canopy, wherein when said cloth canopy is assembled over said table a free end of said conduit means is engaged to said generating means outside said periphery to deliver warm air to said interior of said cloth canopy.

11. The unit according to claim 10, wherein each of two sleeves of said plurality of first sleeves respectively extend along a front end and a back end of said cloth canopy.

12. The unit according to claim 10, wherein one of said plurality of second sleeves extends along an apex of said canopy and each of two other sleeves of said plurality of second sleeves respectively extend along a longitudinal edge of said cloth canopy.

13. The unit according to claim 10, wherein said cloth canopy and said cloth pad have corresponding fastening means thereon to releasably engage said cloth canopy to said cloth pad when said cloth canopy and cloth pad are assembled on said table.

14. The unit according to claim 10, wherein web loops are engaged to said cloth canopy to facilitate assembly and disassembly of said unit.

15. The unit according to claim 9, wherein said fan means is battery powered and releasably engaged within said cloth canopy proximate to said rear closure.

16. The unit according to claim 9, wherein a thermometer extending into said interior of said cloth canopy is releasably engaged to an exterior of said canopy.

* * * * *